US006336832B2

(12) United States Patent
Nobe

(10) Patent No.: US 6,336,832 B2
(45) **Date of Patent: *Jan. 8, 2002**

(54) ELECTRICAL CONNECTOR WITH FEMALE CONTACT ELEMENT

(75) Inventor: Takeshi Nobe, Tokyo (JP)

(73) Assignee: Hirose Electric Co., Ltd., Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/401,723

(22) Filed: Sep. 23, 1999

(30) Foreign Application Priority Data

Sep. 28, 1998 (JP) ..... 10-288695

(51) Int. Cl.[7] ..... H01R 11/22
(52) U.S. Cl. ..... 439/857; 439/910; 439/578
(58) Field of Search ..... 439/851, 852, 439/857, 578, 669, 910, 912

(56) References Cited

U.S. PATENT DOCUMENTS

| | | | | |
|---|---|---|---|---|
| 3,976,350 A | | 8/1976 | Keglewitsch | |
| 4,184,736 A | | 1/1980 | Spaulding | |
| 4,655,522 A | * | 4/1987 | Beck, Jr. et al. | 439/851 |
| 5,037,328 A | * | 8/1991 | Karlovich | 439/578 |
| 5,195,910 A | * | 3/1993 | Enomoto et al. | 439/910 |
| 5,509,821 A | * | 4/1996 | Small et al. | 439/578 |
| 5,532,557 A | * | 7/1996 | Saidian | 439/910 |
| 5,542,861 A | * | 8/1996 | Anhalt et al. | 439/578 |
| 5,634,825 A | | 6/1997 | Maki | |

FOREIGN PATENT DOCUMENTS

| | | | |
|---|---|---|---|
| EP | 0993075 A | | 4/2000 |
| JP | 57-140183 | * | 2/1981 |
| JP | 63-125381 | * | 8/1988 |
| JP | 9-270282 | * | 10/1997 |

* cited by examiner

*Primary Examiner*—Hien Vu
(74) *Attorney, Agent, or Firm*—Kanesaka & Takeuchi

(57) ABSTRACT

An electrical connector comprises a tubular body (1) with a hollow section (2) having a mouth (3), a female contact element (6) with a pair of contact pieces (7) extending in the hollow section (2) forming a throat portion (8) near the mouth (3), and a window (5) provided at a position corresponding to said throat portion (8).

3 Claims, 3 Drawing Sheets

ELECTRICAL CONNECTOR WITH FEMALE CONTACT ELEMENT

BACKGROUND OF THE INVENTION

1. Field of the Invention

The present invention relates to electrical connectors with a female contact element.

2. Description of the Related Art

FIG. 4 shows a conventional connector of this type. An insulating housing has a tubular body 51 with a mouth 53 communicating with a hollow section 52 in which a female contact element 54 is placed.

The female contact element 54 has a pair of contact pieces 55 made by bending a metal strip and supported within the hollow section 52. The contact pieces 55 have free ends near the mouth 53 and are flexible. A throat portion 56 is provided near the free ends, providing an introducing portion 57 between the free end and the throat portion 56.

The inside diameter of the mouth 53 is smaller than the diameter of hollow section 52 but sufficiently large to receive a male contact element 61 of a mating connector. The diameter of the knack section 56 is smaller than the diameter of the male contact element 61.

When the male contact element 61 is inserted through the mouth 53 and introducing section 57 into the throat portion 56, the contact pieces 55 are flexed by the male contact element 61 as shown by phantom line, and the male and female contact elements 61 and 54 are connected under a predetermined contact pressure.

However, the conventional connector has the following disadvantages.

First of all, it is not certain if the female contact element 54 is placed at a regular position. Usually, the female contact element 54 is inserted into the hollow section 52 from bottom and held at a predetermined position. However, the insertion can be too short to place the introducing section 57 at the regular position, resulting in the poor connection between the female and male contact elements 54 and 61.

Secondly, the female contact element 54 and the tubular body 51 have manufacturing and assembling errors. These errors, especially between the mouth 53 and the introducing section 57, should not exceed the nominal tolerance. The position of the introducing section 57 in the free state prior to contact with the male contact element 61 should be aligned with the edge of the mouth 53. If the tip of the introducing section 57 falls inside the mouth 53, the male contact element 61 crashes the introducing section 57, damaging the female contact element 54. If the crashing force is very large, the male contact element 61 can be damaged, too.

SUMMARY OF THE INVENTION

Accordingly, it is an object of the invention to provide an electrical connector enabling to check if the female contact element is placed at a regular position.

It is another object of the invention to provide an electrical connector with a wide introducing section.

According to the invention there is provided an electrical connector with a female contact element, comprises a tubular body with a hollow section having a mouth at an end of the tubular body; a air of contact pieces of the female contact element extend within the hollow section along axis of the tubular body, at least one of the contact pieces being bent towards the other contact piece near the mouth to thereby provide a throat portion which is flexed back by a pin-like male contact element of a mating connector, and at least one window provided in the tubular body at a position corresponding to the throat portion.

Whether the throat portion of the female contact element is placed at a regular position is observed through the window. If the female contact element is not at the regular position, it may be eliminated or corrected.

According to an embodiment of the invention, the window has a width greater than that of the hollow section in a direction perpendicular to the axis of the tubular body to thereby provide a wider introducing area of the contact pieces, thereby preventing the male contact from crashing the female contact element. The window is position in an X direction perpendicular to a Y direction in which the contact pieces are opposed. Alternatively, the window is positioned in the Y direction. An outer conductive shell is provided over the tubular body to adapt it to coaxial connector.

BRIEF DESCRIPTION OF THE INVENTION

DESCRIPTION OF THE PREFERRED EMBODIMENTS

Embodiments of the invention will now be described with reference to FIGS. 1 and 3.

Figure 1:
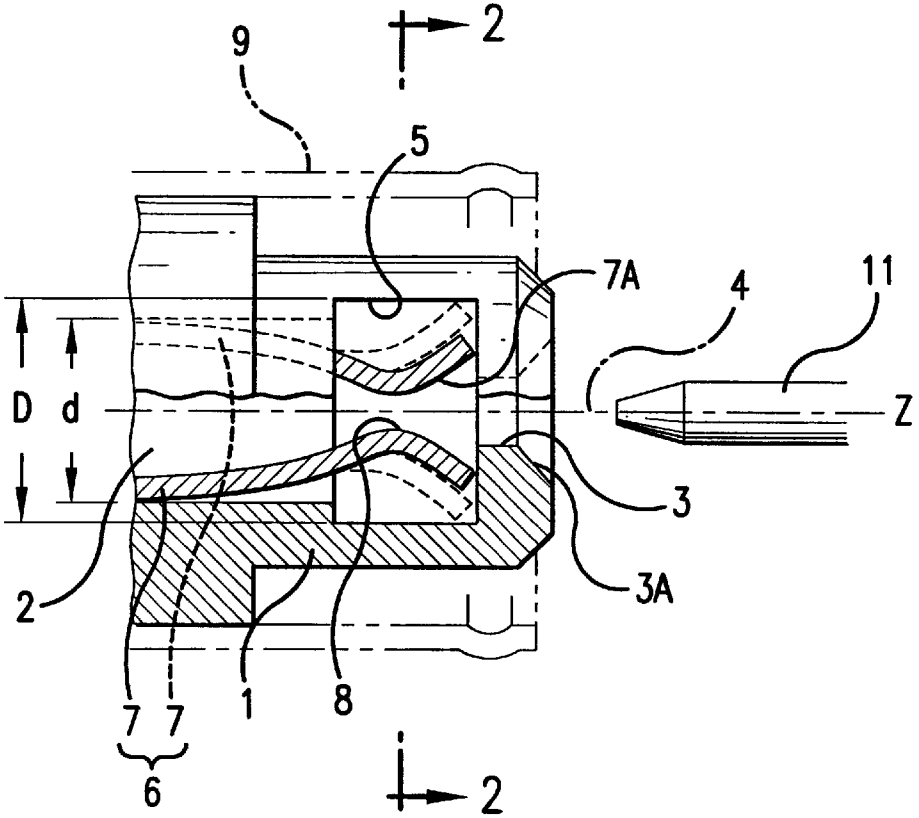
FIG. 1 is a side elevational view, partially in section, of an electrical connector according to an embodiment of the invention.
Figure 2:
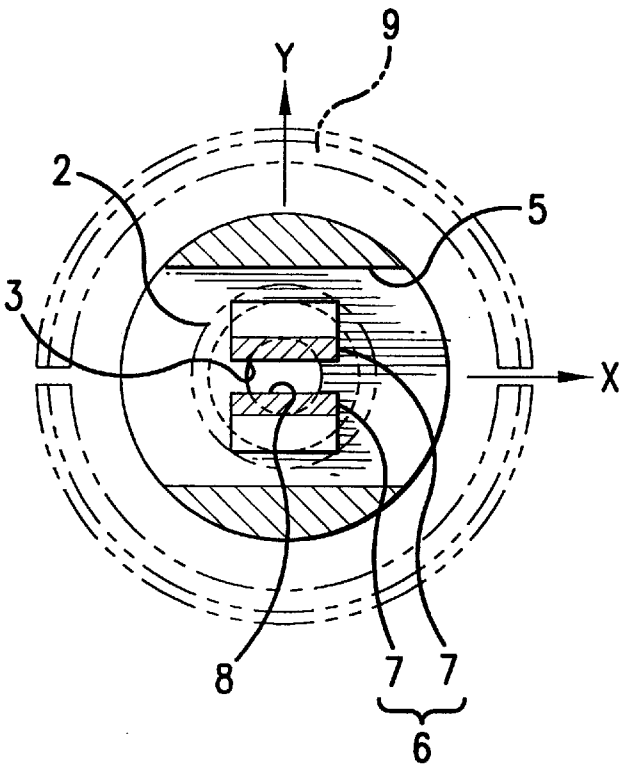
FIG. 2 is a sectional view taken along line 2—2 of FIG. 1.

In FIGS. 1 and 2, the insulating housing has a tubular body 1 with a hollow section 2 which communicates with a mouth 3 of the tubular body 1. The tubular body 1 has a substantially cylindrical shape with a shoulder. The hollow section 2 extends along the axis 4 (z-direction) of the tubular body 1 and communicates with the mouth 3 which as a diameter smaller than that of the hollow section 2. The mouth 3 has an inside diameter slightly larger than the outside diameter of the pin-like male contact element 11 and a tapered portion 3A gradually broadening toward the end of the tubular body 1. A window 5 is provided in the tubular body 1 in the radial or X direction. The special relationship between the window 5 and the female contact element 6 within the elongated cavity 2 will be described later.

The female contact element 6 has a pair of contact pieces 7 and is inserted into the hollow section 2 to a predetermined position. The contact pieces 7 are provided within the hollow section 2 on opposite sides of the axis 4 of the tubular body 1 so as to oppose to each other in the Y direction. The end portions of the contact pieces 7 are bent to provide a throat portion 8. The distance between the contact pieces 7 in the throat portion 8 is smaller than the outside diameter of the male contact element 11. An introducing section 7A, in which the distance between the contact pieces 7 gradually increases, is provided between the throat portion 8 and the free end of the contact piece 7.

The size and position of the window 5 are such that they enable to determine whether the throat portion 8 of the female contact element 6 is at the regular position. That is, when the female contact element 6 is inserted into the hollow section 2 of the tubular body 1 at the regular position, the window 5 is positioned within a certain range from the throat portion 8 in the Z direction. The width (Y direction) of the window 5 is greater than the diameter of the hollow section 2.

Figure 3:
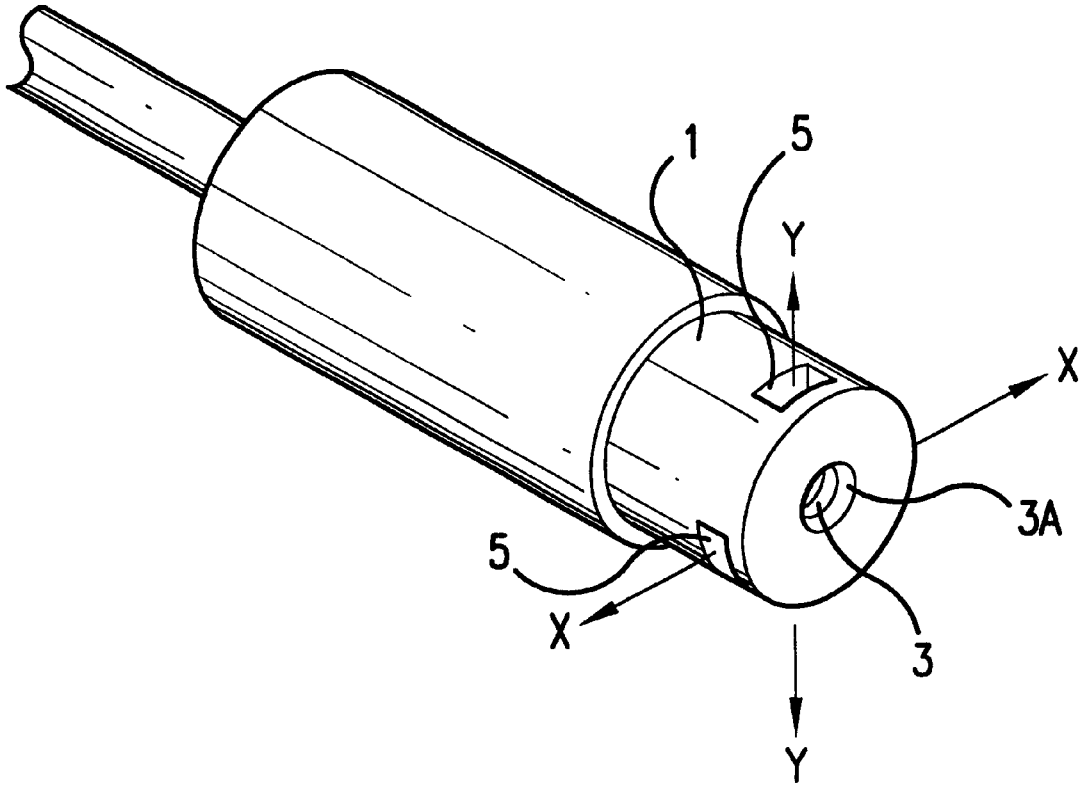
FIG. 3 is a perspective view of an electrical connector according to another embodiment of the invention.
Figure 4:
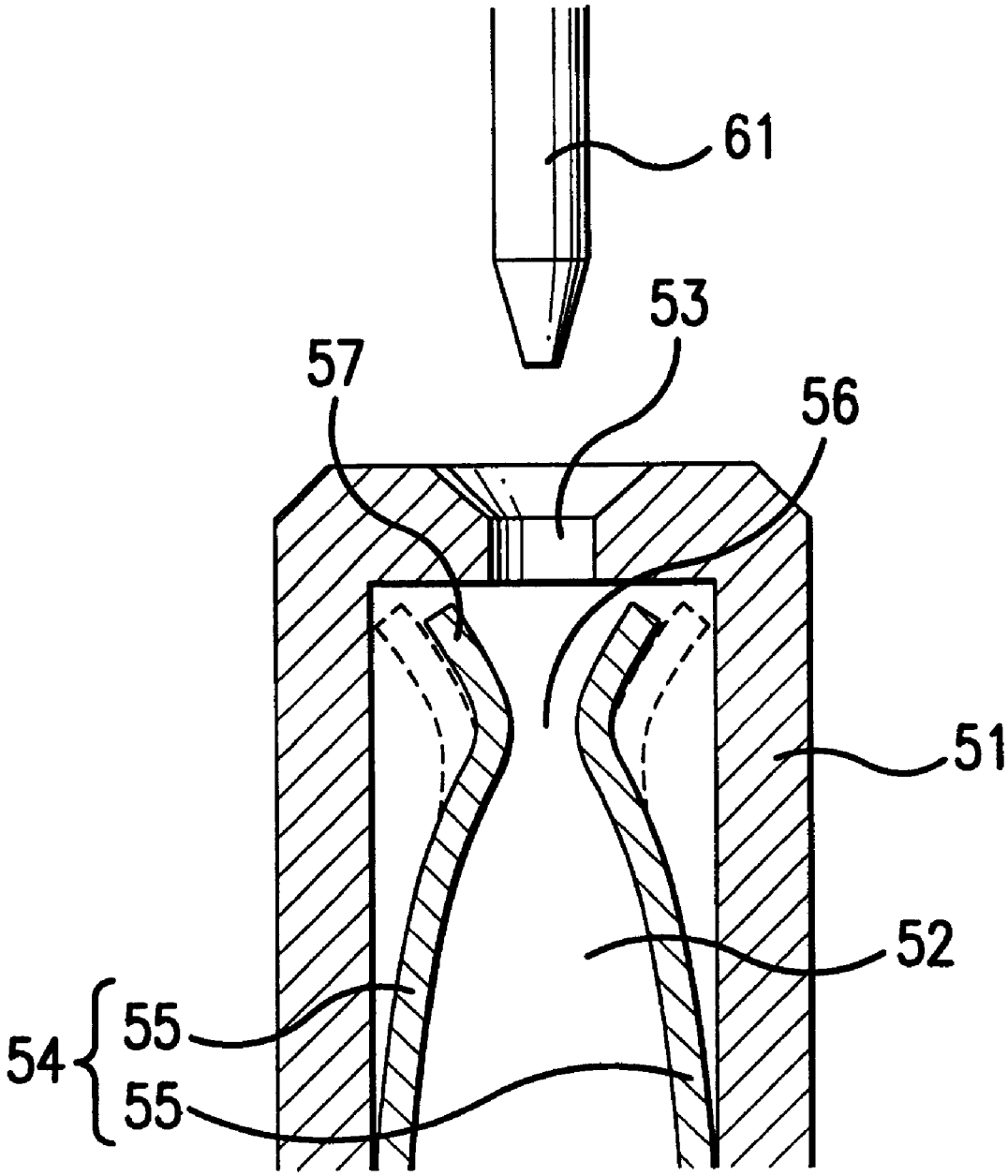
FIG.4 PRIOR ART
FIG. 4 is a sectional view of a conventional electrical connector.

In FIG. 3, windows 5 are provided in both X and Y directions.

By providing the window 5 wider than the hollow section 5, it is possible to provide the female contact element 6 with the introducing section 7A which is greater than the conventional one. The receiving area of the introducing section 7A is larger than the inside diameter of the mouth 3 of the tubular body 1. Thus, even if the manufacturing or assembling error of the female contact element 6 and the housing is very large, the introducing section 7A satisfactorily covers the mouth 3.

How to assemble the connector will be described below.

The female contact element 6 is inserted into the hollow section 2 of the tubular body 1 from left to the predetermined position in FIG. 1. Whether the throat portion 8 of the female contact element 6 is at the regular position is determined by observation through the window 5. If the throat 8 is not at the regular position, the female contact element 6 is removed and inserted again. When the connector is connected to a mating connector, the window 5 may be used to check if the throat portion 8 is at the regular position.

Upon entering via the mouth 3, the male contact element 11 of a mating connector is guided by the introducing section 7A of the female contact element 6 to the throat portion 8, wherein it flexes the contact pieces 7 thereby making an electrical connection. Even if the introducing section 7A is slightly shifted from the regular position, it is able to guide the male contact element 11 to the throat portion 8 without fail.

As shown in FIGS. 1 and 2, an outer conductive shell 9 is provided around the tubular body 1 to adapt it to a coaxial connector.

Since a window is provided in the tubular body in such an area that the female contact element is brought into contact with a mating connector, it is possible to detect a defect product during the manufacture, thereby avoiding poor connection at a time of use. By making the window wider than the hollow section, it is possible to broadening the introducing area of the female contact element, thereby avoiding damage to the female contact element by the male contact element even if the position of the introducing section is shifted from the regular position by manufacturing and assembling errors.

What is claimed is:

1. An electrical connector with a female contact element, comprising:

a tubular body;

a hollow section positioned in said tubular body and having a diameter (d);

at least two windows extending from said hollow section in said tubular body and having a width (D) which is larger than said diameter (d) of said hollow section;

a mouth extending from said window, provided at an end of said tubular body for receiving a pin-like male contact element of a mating connector, and having a diameter which is smaller than said width (D) of said windows, said windows positioned adjacent to said mouth;

a pair of contact pieces of said female contact element extending in and along said tubular body from said hollow section and partially to said window, at least one of said contact pieces being bent towards the other contact piece to provide a throat portion and being bent again away from said other contact piece to provide an introducing section, both said throat portion and said introducing section provided at positions corresponding to said window, said introducing section being flexed back and engaged with inner walls of said tubular body when said pin-like male contact element of said mating connector is inserted into said tubular body, said introducing section having a receiving area which is greater than an inside diameter of said mouth to smoothly guide said mating connector; and an outer conductive shell including an inner radial groove adjacent to said mouth, and said outer conductive shell covering said tubular body and said windows.

2. An electrical connector with a female contact element according to claim 1, wherein said window is positioned in an X direction perpendicular to a Y direction in which said contact pieces are opposed.

3. An electrical connector with a female contact element according to claim 1, wherein said window is positioned in a Y direction in which said contact pieces are opposed.

* * * * *